US007741761B2

(12) United States Patent
Jaffrezic et al.

(10) Patent No.: US 7,741,761 B2
(45) Date of Patent: Jun. 22, 2010

(54) RADIOFREQUENCY PLASMA SPARK PLUG

(75) Inventors: Xavier Jaffrezic, Velizy (FR); Andre Agneray, Boulogne (FR)

(73) Assignee: RENAULT s.a.s., Boulogne Billancourt (FR)

( * ) Notice: Subject to any disclaimer, the term of this patent is extended or adjusted under 35 U.S.C. 154(b) by 447 days.

(21) Appl. No.: 11/719,403

(22) PCT Filed: Oct. 27, 2005

(86) PCT No.: PCT/FR2005/050909

§ 371 (c)(1),
(2), (4) Date: May 16, 2007

(87) PCT Pub. No.: WO2006/054009

PCT Pub. Date: May 26, 2006

(65) Prior Publication Data

US 2009/0146542 A1 Jun. 11, 2009

(30) Foreign Application Priority Data

Nov. 16, 2004 (FR) ..... 04 12153

(51) Int. Cl.
*H01T 13/20* (2006.01)

(52) U.S. Cl. ..... 313/141

(58) Field of Classification Search ..... 313/141
See application file for complete search history.

(56) References Cited

U.S. PATENT DOCUMENTS 4,142,121 A * 2/1979 Carpenter ..... 313/131 A

FOREIGN PATENT DOCUMENTS

| | | |
|---|---|---|
| DE | 197 23 784 | 8/1998 |
| EP | 1 515 594 | 3/2005 |
| FR | 2 771 558 | 5/1999 |
| FR | 2 796 767 | 1/2001 |
| FR | 2 859 830 | 3/2005 |
| FR | 2 859 831 | 3/2005 |
| FR | 2 859 869 | 3/2005 |
| FR | 2 816 119 | 5/2005 |
| JP | 57 186 066 | 11/1982 |
| RU | 2 099 584 | 12/1997 |

OTHER PUBLICATIONS

U.S. Appl. No. 12/090,722, filed Apr. 18, 2008, Agneray, et al.

* cited by examiner

*Primary Examiner*—Peter Macchiarolo
(74) *Attorney, Agent, or Firm*—Oblon, Spivak, McClelland, Maier & Neustadt, L.L.P.

(57) ABSTRACT

A radiofrequency plasma spark plug configured to equip a combustion chamber including: an annular shell with a main axis; a central electrode made of a conductive material, extending along the main axis and including an inner portion arranged inside the annular shell and an outer portion arranged outside the annular shell; an annular electrically insulating part extending at least about the inner portion of the central electrode so as to be interposed between the shell and the electrode, the insulating part only covering part of the outer portion of the central electrode. The insulating part includes an annular flange concealing the entire circular terminal surface of the shell relative to the uncovered part of the electrode.

13 Claims, 1 Drawing Sheet

BACKGROUND ART

RADIOFREQUENCY PLASMA SPARK PLUG

BACKGROUND OF THE INVENTION

I. Field of the Invention

The present invention relates in general to radiofrequency plasma spark plugs.

More specifically, the invention relates to a spark plug, known as a radiofrequency plasma spark plug, intended to equip a combustion chamber of an internal combustion engine, and comprising:

- an annular shell of main axis D formed in a first conducting material and having first and second ends and an end circular surface with a main axis of symmetry D located at the first end of the shell;
- a central electrode formed in a second conducting material extending along the main axis D and comprising an internal portion positioned inside said annular shell and an external portion positioned on the outside of said annular shell, nearer to the first end of the shell than to the second;
- an electrically insulating component of annular shape extending at least around the internal portion of the central electrode such as to be inserted between the shell and the electrode, this insulating component covering only part of the external portion of the central electrode such that the uncovered part of the external portion is in contact with a gaseous mixture surrounding the spark plug.

II. Description of Related Art

Ignition in gasoline internal combustion engines, which consists in initiating combustion of an air-fuel mixture in a combustion chamber of said engine, is relatively well controlled in current engines.

However, in order to comply with emissions standards, motor manufacturers have developed controlled-ignition engines capable of running on lean air-fuel mixtures, that is to say mixtures which contain an excess of air with respect to the amount of fuel injected.

Igniting a fuel-lean mixture is, however, difficult to control. As a result, and in order to improve the probability of successful ignition, it is necessary to have more fuel-rich mixtures around the spark plug at the instant the spark is produced.

Still with a view to increasing the probability that the spark plug will ignite the mixture, novel spark plugs with surface sparks have been developed in order to produce larger sparks to cope with the problem of the spatio-temporal meeting between the fuel mixture and the spark. Thus, a larger volume of mixture is ignited, and the probability of initiating combustion is therefore very greatly improved.

Such spark plugs are described in particular in patent applications FR97-14799, FR99-09473 and FR00-13821. Such spark plugs generate large-sized sparks from small potential differences.

Surface spark plugs have a dielectric (insulating component) separating the electrodes (one electrode being the annular shell and the other electrode being the central electrode) in the region where the distance between them is the smallest; the sparks formed between the electrodes are thus guided onto the surface of the dielectric. These spark plugs magnify the inter-electrode field at the surface of the dielectric. In order to do that, the elementary capacitors formed by the dielectric and an underlying electrode are progressively charged. The spark plugs generate a spark which travels along the surface of the insulator in the regions where the electric field in the air/gaseous mixture is the strongest.

BRIEF SUMMARY OF THE INVENTION

In this context, one object of the present invention is therefore to provide a spark plug which, once assembled in a combustion chamber, is able to increase the probability of the mixture surrounding the spark plug being ignited.

To this end, the spark plug of the invention, in other respects in accordance with the generic definition given in the aforementioned preamble, is essentially characterized in that the insulating component has an annular shoulder masking the entire end circular surface of the shell with respect to the uncovered part of the electrode.

With such a spark plug:

- on the one hand, the distance separating the shell of the spark plug from the central electrode (along a path passing along the surface of the insulating component) is particularly long because it exceeds the minimum dimension of the end circular surface (that is to say the diameter of this circular surface);
- and, on the other hand, the central electrode and the shell are separated by the insulating component and therefore do not face one another.

These two reasons mean that when power is applied to the electrode and the shell in order to create a large electric potential difference (generally varying from 5 kV to 35 kV in terms of absolute peak values) between them, there can be no electric arcing between the end circular surface of the spark plug and the central electrode.

More generally, when the spark plug according to the invention is assembled in a vehicle combustion engine, with the part of the central electrode that is not covered with insulation positioned inside the chamber and with the shell assembled into the thickness of the wall of the chamber, there can be no electric arcing between the shell and the central electrode. Indeed, access to the shell from the uncovered part of the central electrode is prevented by the presence of the insulation.

Under such conditions, the spark plug according to the invention, when energized at a radiofrequency, that is to say when an AC voltage is applied between the shell and the central electrode (said AC voltage for example being greater than 5 kV and having a frequency in excess of 1 MHz) forms a branched plasma near the central electrode rather than an electric arc. It must be clearly understood that this voltage and given frequency are suited to the creation of a plasma in a gaseous mixture having a molar density in excess of $5\times10^{-2}$ mol/l.

The term plasma or branched plasma used hereinafter denotes the simultaneous generation of at least several ionizing lines or paths in a given gaseous volume, their branching furthermore being omnidirectional.

Whereas a volume plasma implies heating up the entire volume in which it is to be generated, a branched plasma requires heating only along the path of the sparks formed. Thus, for a given volume, the energy required for a branched plasma is markedly lower than the energy required by a volume plasma.

The branched plasma generated by the spark plug according to the invention is generated some distance from the insulating component, toward the walls of the chamber which face the central electrode, thus making it possible to reduce the probability of arcing with the shell and correspondingly allowing electrode wear to be reduced.

By comparison with an electric arc, a plasma has the advantage of comprising a great many ionizing or sparking paths in a significant volume of gas situated around the central electrode, thus increasing the probability that the mixture containing the oxidizing agent will be ignited.

One difference between an electric arc and a branched plasma is that:

the arc consists of a single sequence of ionized gas molecules stretching directly between the electrodes and allows electrons to be transferred from one electrode to the other in order to reduce the electric potential difference there is between these powered electrodes, whereas:

the plasma produced according to the invention is a collection of numerous chains of ionized gas molecules stretching in a disordered fashion around the energizing electrode and emanating from said electrode. These multiple chains allow electrons to be sequences transferred back and forth between said electrode and the nearby air.

The formation of a spark is initiated by plucking from the medium (the gaseous mixture) a few electrons which are subjected to a strong electric field. When a high voltage is applied between the electrodes, electrons from one electrode are accelerated by the electrostatic forces generated between the electrodes and bombard the air-containing gaseous mixture. The portion of the electrode that experiences the strongest electrostatic field (generally a corner of an electrode or a spiked point close to the other electrode) is the starting point for the first avalanche. The air molecules are heated and release an electron and a photon which, in their turn, ionize further air molecules. Thus, a chain reaction ionizes the air when a high voltage is applied between electrodes which are separated by an insulator.

The ionized air around the central electrode has a potential close to that of this central electrode and behaves like a continuation thereof. As the avalanche front (the name given to a massive wave of migration of electric charges in the gaseous mixture) spreads, the electric field is amplified upstream of the front and encourages the creation of further avalanches. Thus, the phenomenon has a tendency to be self-sustaining, creating around the central electrode a conducting ionized gaseous mass moving toward the walls of the chamber.

As specified earlier, the spark plug of the invention has an AC voltage applied to it, thus making it possible to vary the potential difference between the central electrode and the shell/chamber, it being possible for this potential difference to be reversed. On each change of potential/polarity, the electrons are increasingly accelerated in opposite directions. A polarization wave thus travels, oscillating at the energizing frequency, in each period recovering the charges shed in the previous period. Each alternation therefore causes the wave to spread to a greater extent than the previous one; it is thus possible with the spark plug of the invention powered in this way to obtain relatively large sizes of sparks with relatively high voltages applied between the electrode and the shell. Energizing such a spark plug at a radio frequency additionally makes it possible to avoid arcing and eliminate the variations in flash-over voltage between successive cycles.

It is, for example, possible to contrive for the end circular surface of the shell to bear against a complementary bearing surface of the shoulder of the insulating component. This feature makes it possible to eliminate the space between the insulating component and the shell, and so the heat associated with the presence of a flame initiated by the plasma can be dissipated to the shell, thus avoiding overheating the ceramic.

It is also possible to contrive for the insulating component to have a minimum thickness situated on the inside of said shell, and the shoulder of the insulating component to have a shoulder thickness greater than or equal to half said minimum thickness.

This feature makes it possible to avoid the join between the uncovered part of the central electrode, and therefore the air/ceramic/central electrode join lying too close to the shell. If this uncovered part of the electrode or, more specifically this join, did lie too close to the shell, it could constitute a region where a surface spark could be emitted.

It is also possible to contrive for the shell, the electrically insulating component and the central electrode to be components exhibiting symmetry of revolution, their common axis of symmetry being the main axis D.

The precision on the relative placement of the constituent parts of the spark plug with respect to a common axis of symmetry allows the branched plasma to be centered about this axis D and about the central electrode, thus making it easier to localize the region where the sparks are produced within the combustion chamber.

It is also possible to contrive for the annular shell to have the shape of a cylindrical tube comprising, at the first end of the shell, an internal chamfer that comes into contact with the end circular surface, this internal chamfer being in contact with a complementary chamfer formed on a portion of the insulating component.

This assembling of the insulating component against the shell using complementary chamfers allows a better distribution of the mechanical stresses there are between the shell and the insulating component thus reducing, or even completely eliminating any sharp corners of the shell in contact with the insulating component. Excessive or poorly distributed mechanical stresses could lead to breakage of the ceramic and damage to the spark plug. Thus, this feature of mutually complementing chamfers allows the life of the spark plug and its ability to withstand high temperatures and temperature variations to be improved.

This embodiment also makes it possible to increase the area of contact between the insulating component and the shell, thus assisting with heat transfer from the insulating component to the shell and preventing this insulating component from becoming overheated.

Optimally, in order to distribute the mechanical stresses between the insulating component and the shell, the internal chamfer has a cross section, on a plain parallel to the main axis D, that is of rounded shape.

It is also possible to contrive for the annular shoulder to comprise an end distant from the annular shell and at the exterior periphery of which there is formed a rounded peripheral chamfer coaxial with the main axis D.

This peripheral chamfer reduces or eliminates the presence of a sharp corner near the exterior periphery of the annular component at the end of the annular shoulder.

BRIEF DESCRIPTION OF THE DRAWINGS

Other features and advantages of the invention will emerge clearly from the description thereof given hereinafter by way of entirely nonlimiting indication with reference to the attached drawings, in which.

DETAILED DESCRIPTION OF THE INVENTION

Figure 1:
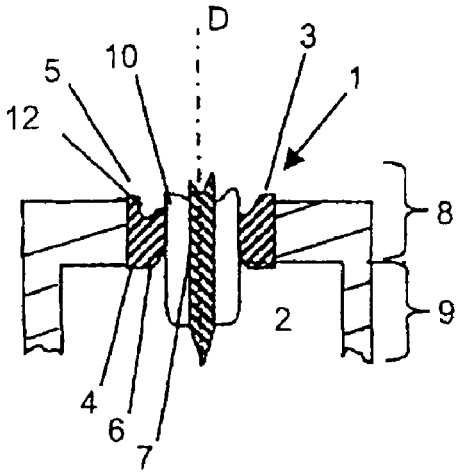
FIG. 1 depicts a spark plug described in French patent applications FR03-10766, FR03-10767 and FR03-10768, filed by the Applicant Company and not yet published.

The spark plug 1 of FIG. 1 is a spark plug developed by the Applicant Company to be used as a plasma-generating spark plug. This spark plug is covered by patent applications which at the date of filing of the current application had not yet been published.

This spark plug comprises a cylindrical central electrode 7 of the axis of symmetry D of which a portion, termed the internal portion 8, is positioned inside and some distance from an annular shell 3 which has the form of a cylindrical tube of axis D, and another portion, termed the external portion 9, which is positioned on the outside of annular shell 3.

An insulating component of annular shape is also positioned partly inside the annular shell, around the central electrode, so as to separate the shell from the central electrode 7. The insulating component, the central electrode and the shell 3 are components which exhibit symmetry of revolution about the axis D. The external portion 9 of central electrode 7 has an uncovered part 16, that is to say a part not surrounded by the electrically insulating component 10 and not surrounded by the shell 3, this uncovered part 16 being positioned inside the combustion chamber 2 of the engine.

The shell 3 has an external circular surface in the form of a flat disk perforated at its center and having, as its axis of symmetry, the axis D, being positioned perpendicular to this axis D. The shell 3 has a connection with the wall of the chamber 2, this generally involving screwing the shell into a hole made through the wall. The shell of the spark plug thus assembled with the wall of the chamber 2 is therefore at equipotential with respect to this wall, that is to say, is electrically grounded.

When the central electrode has applied to it an AC voltage centered about the ground potential, this voltage having a frequency ranging between 1 and 10 MHz, the electrons situated near the spiked point 17 of the central electrode travel either from the electrode toward the walls of the chamber, through the gaseous mixture surrounding the chamber, or from the gaseous mixture toward the electrode. In both instances, the electrical alternation is such that an electron does not have time to pass from the central electrode to the wall of the chamber. The air can thus be ionized without there being any true electric discharge between the two electrical terminals formed by the central electrode 7 and by the wall of the chamber 2. This ionization creates a localized plasma around the spiked point 17 of the central electrode and this concentrates the moving electric charges around a small exchange volume.

However, it has been found that, with this type of electrode, electrical discharges between the spiked point and the shell may arise in the frequency range between 1 MHz and 10 MHz. These discharges leave the annular shell and spread along the insulating component along the axis of the central electrode. This method of obtaining a spark is undesirable because it keeps the spark close to the insulating component and thus encourages cooling of the flame thus created.

Figure 2A:
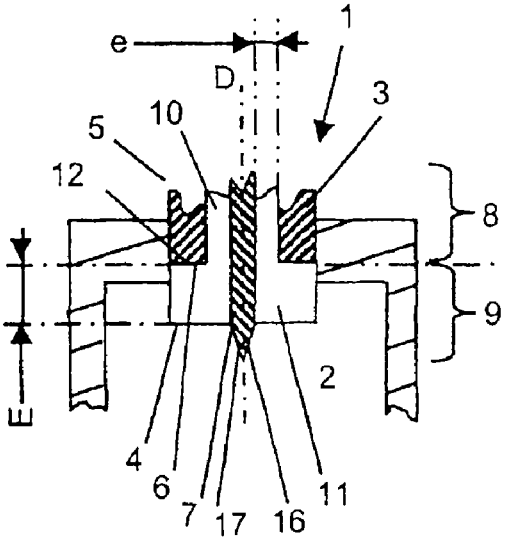
FIGS. 2*a*, 2*b* and 2*c* depict embodiments of the spark plug according to the invention.
Figure 2B:
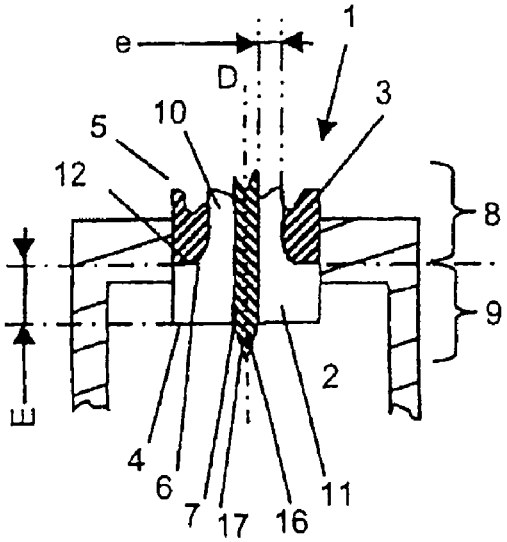
Figure 2C:
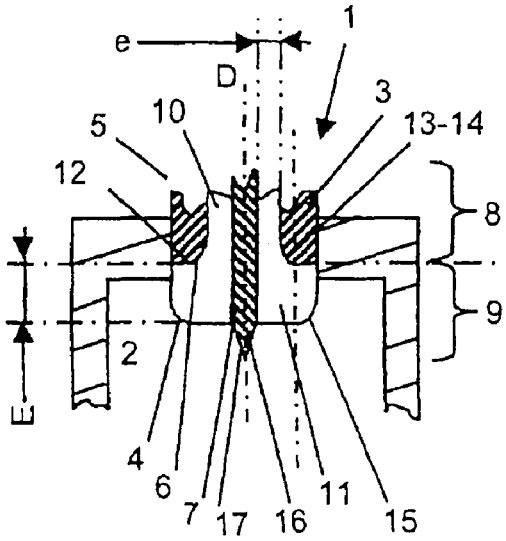

The spark plugs of the types set out in FIGS. 2A, 2B and 2C have been developed in order to alleviate this disadvantage.

The spark plugs in those figures have all the features described in respect of the spark plug referred to in FIG. 1 but also have a shoulder 11 made on the insulating component 10 and masking the external circular surface 6 of the shell 3.

This shoulder 11 increases the distance, traveling through the gaseous mixture, between the electrode and the shell, thus making it possible to prevent arcing between the central electrode 17 and the shell 3.

By virtue of this configuration, the electrodes of FIGS. 2A, 2B and 2C once positioned with the spiked point inside the chamber 2 and powered with AC current by a high voltage AC generator, create a plasma at their spiked points 17.

The minimum thickness "e" of the insulating component lies inside the shell 3 and its maximum thickness "E" lies in the region of the shoulder 11.

The shoulder of the insulating component 10 of FIG. 2A is a shoulder which in longitudinal section exhibits right angles that may introduce concentrations of load and mechanical stress.

For that reason, the spark plugs in FIGS. 2B and 2C have an internal chamfer 13 at the first end 4 of the shell 3.

The insulating component 10 has a complementary chamfer 14 that comes into contact with the internal chamfer 13. This large contact area allows the heat to be removed from the insulating component to the shell, thus extending the average life of the spark plug.

Also, the spark plug according to the invention in FIG. 2C has a rounded peripheral chamfer 15 formed on the annular shoulder 11, at the point on the shoulder that is axially furthest from the shell 3.

This shoulder makes it possible to avoid having a right angle at the shoulder, in the path through the gaseous mixture between the spiked point 17 and the annular shell 3. This rounded edge reduces the risk of arcing.

The first and second conducting materials which are the respective materials of the central electrode and of the shell 3 are, according to one particular embodiment of the invention, the same as one another. These materials are metallic materials such as copper alloys.

According to one particular embodiment of the invention, the end of the central electrode 7 may consist of a copper core surrounded by a nickel sleeve.

The insulating material is preferably a ceramic with a dielectric strength in excess of 20 kV/mm.

The invention claimed is:

1. A spark plug, configured to equip a combustion chamber of an internal combustion engine, comprising:

an annular shell having a main axis, the annular shell being comprised of a first conducting material and including a first end, a second end, and an end circular surface having a main axis of symmetry, the end circular surface located at the first end of the annular shell;

a central electrode comprised of a second conducting material, the central electrode extending along the main axis of the annular shell and including an internal portion positioned inside the annular shell and an external portion protruding out of the first end of the annular shell; and an electrically insulating component of annular shape inserted between the annular shell and the central electrode, the electrically insulating component covering at least a part of the internal portion of the central electrode extending from the first end of the annular shell toward the second end of the annular shell, and covering only a part of the external portion of the central electrode protruding out of the first end of the annular shell such that an uncovered end part of the external portion is in contact with a gaseous mixture surrounding the spark plug;

wherein the electrically insulating component comprises an annular shoulder masking the entire end circular surface of the annular shell from the uncovered end part of the external portion of the central electrode, and wherein the spark plug is configured to create a branched plasma in the combustion chamber between the uncovered end part of the external portion of the central electrode and walls of the combustion chamber.

2. The spark plug as claimed in claim 1, wherein the end circular surface of the annular shell bears against a complementary bearing surface of the annular shoulder of the electrically insulating component.

3. The spark plug as claimed in claim 1, wherein the electrically insulating component has a minimum thickness situated on the inside of the annular shell, and the annular shoulder of the electrically insulating component has a shoulder thickness greater than or equal to half the minimum thickness.

4. The spark plug as claimed in claim 1, wherein the end circular surface has a shape of a flat disk pierced at a center of the flat disk.

5. The spark plug as claimed in claim 1, wherein the annular shell, the electrically insulating component, and the central electrode are symmetrical about a common axis of symmetry, the common axis of symmetry being the main axis.

6. The spark plug as claimed in claim 5, wherein the annular shell has a shape of a cylindrical tube comprising, at the first end of the annular shell, an internal chamfer that comes into contact with the end circular surface, the internal chamfer being in contact with a complementary chamfer included on a portion of the electrically insulating component.

7. The spark plug as claimed in claim 6, wherein the internal chamfer has a cross section, on a plane parallel to the main axis, of rounded shape.

8. The spark plug as claimed in claim 5, wherein the annular shoulder comprises an end distant from the annular shell, wherein an exterior periphery of the shoulder includes a rounded peripheral chamfer which is coaxial with the main axis.

9. The spark plug as claimed in claim 1, wherein the uncovered end part of the central electrode comprises a spiked point.

10. The spark plug as claimed in claim 1, wherein the insulating component is ceramic.

11. The spark plug as claimed in claim 10, wherein the insulating component has a dielectric strength greater than 20 KV/mm.

12. The spark plug as claimed in claim 1, wherein the uncovered end part of the central electrode comprises a copper core surrounded by a nickel sleeve.

13. The spark plug as claimed in claim 1, wherein the spark plug is configured to receive an AC voltage between the shell and the central electrode to create a branched plasma between the uncovered end part of the external portion of the central electrode and walls of the combustion chamber facing the uncovered end part.

* * * * *